United States Patent [19]

Thomas, Jr.

[11] 4,095,297

[45] Jun. 20, 1978

[54] COIL SPRING ASSEMBLY

[75] Inventor: Herbert J. Thomas, Jr., Holland, Mich.

[73] Assignee: Holland Wire Products, Inc., Holland, Mich.

[21] Appl. No.: 796,001

[22] Filed: May 11, 1977

[51] Int. Cl.[2] ..... A47C 23/04

[52] U.S. Cl. ..... 5/256; 5/267; 5/269

[58] Field of Search ..... 5/248, 256, 267, 269; 267/95, 97

[56] References Cited

U.S. PATENT DOCUMENTS

| | | | |
|---|---|---|---|
| 1,337,320 | 4/1920 | Karr | 5/256 |
| 1,816,238 | 7/1931 | Steele | 5/248 |
| 1,860,642 | 5/1932 | Zimmerman | 5/248 |
| 1,899,087 | 2/1933 | Foster | 5/269 |
| 2,257,375 | 9/1941 | Gleason | 5/269 |

*Primary Examiner*—Casmir A. Nunberg

*Attorney, Agent, or Firm*—Price, Heneveld, Huizenga & Cooper

[57] ABSTRACT

A coil spring assembly stable against torque twist deterioration, assembled of rows of coils of alternate right and left-hand, the coils having wound ends, the end turns of each coil having linear portions normal to the row and interconnected with linear portions of adjacent coils by cross helicals extending across the assembly normal to the rows.

3 Claims, 3 Drawing Figures

COIL SPRING ASSEMBLY

BACKGROUND OF THE INVENTION

This invention relates to end wound coil spring assemblies.

Knotted, i.e. wound ends on wire coils in a coil spring assembly are usually desirable for comfort and spring stability. There is a tendency however, for such assemblies to develop squeeks after a time. This tendency can be disturbing and/or embarrassing to users of the spring assembly, as well as to others in the vicinity. This tendency is believed due to the fact that the helical torque which is inherent in coils under vertical load, when repeatedly exerted, ultimately causes slippage of the wound end of the adjacent turn around which it is wound, and this metal to metal slippage generates squeeks.

SUMMARY OF THE INVENTION

The primary object of this invention is to provide a knotted spring mattress which is stable against torque twist deterioration. The unit constitutes a combination of specially interacting features. Alternate rows of right and left-hand knotted coils have abutting linear portions on their respective end turns, interconnected to each other by encircling cross helicals that interconnect the rows.

DESCRIPTION OF THE PREFERRED EMBODIMENT

Figure 1:
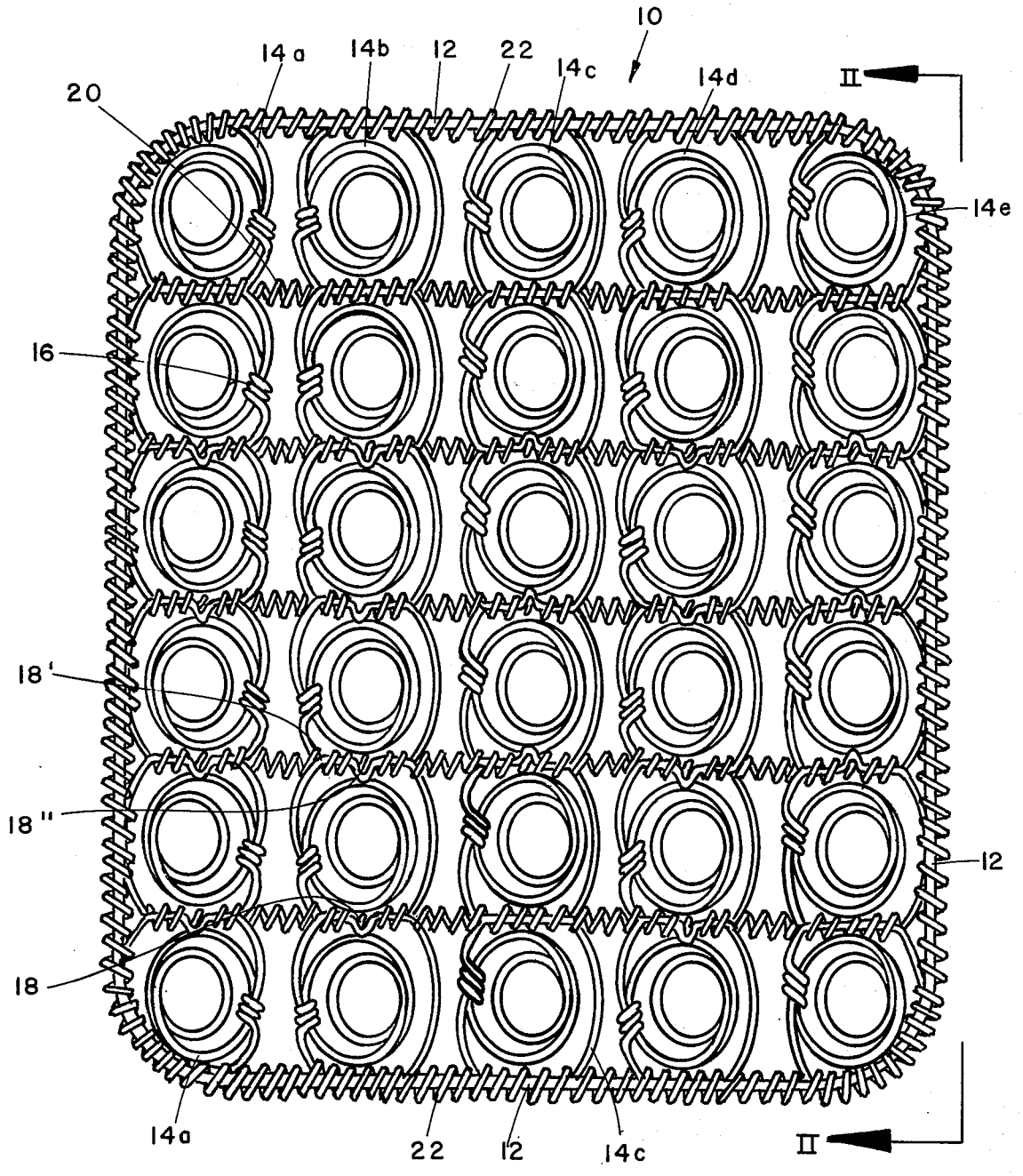
FIG. 1 is a plan view of an assembly embodying the present invention.
Figure 2:
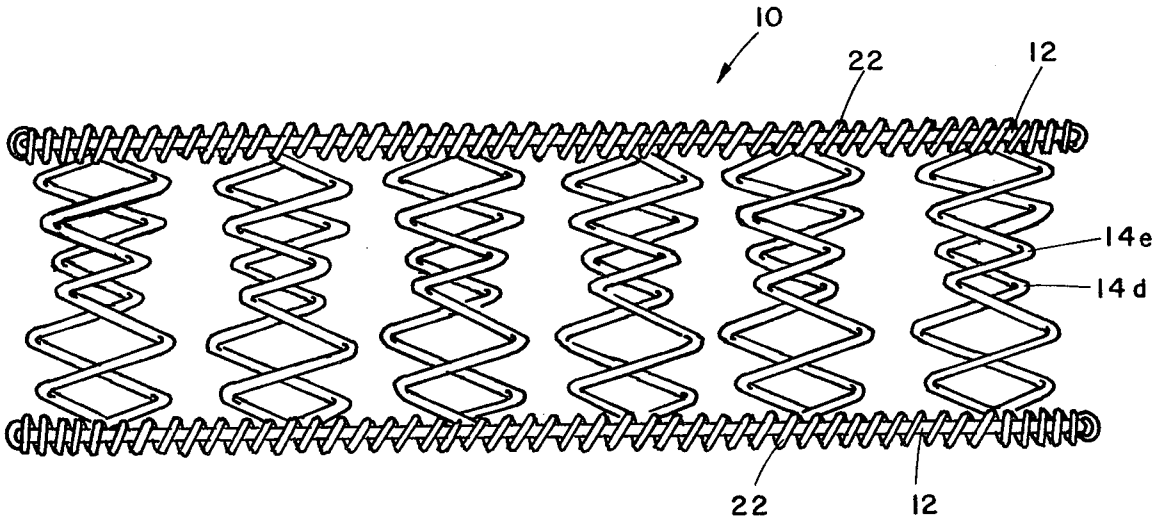
FIG. 2 is an elevational view of the assembly in FIG. 1 taken in the direction II—II.

The novel coil spring assembly is depicted in the drawings as including five rows of coil springs, in six files, thereby constituting an assembly with dimensions approximately those of a seating cushion. This relatively small number of coil springs is purposely depicted to enable the drawings to most clearly show the details of the structural features. If a mattress is to be made in accordance with the invention, many more rows of coil springs would be employed, but the structural features would be the same.

The coil spring assembly 10 employs a pair of peripheral supports 12, i.e. support rods, each lying in a plane, and the two lying in a pair of parallel spaced planes to peripherally define the boundaries of the assembly. Within these boundaries is a plurality of individual wire coil springs. The springs 14*a*, 14*b*, 14*c*, 14*d*, and 14*e* are in five parallel rows from one end of the assembly to the other, these springs being aligned crosswise to form six files of springs from one side of the assembly to the other. These coil springs in the sequential parallel rows across the assembly have alternate right-hand and left-hand helical coils, i.e. in the exemplary depicted form, rows 14*a*, 14*c* and 14*e* have right-hand coils while alternate rows 14*b* and 14*d* have left-hand coils.

Figure 3:
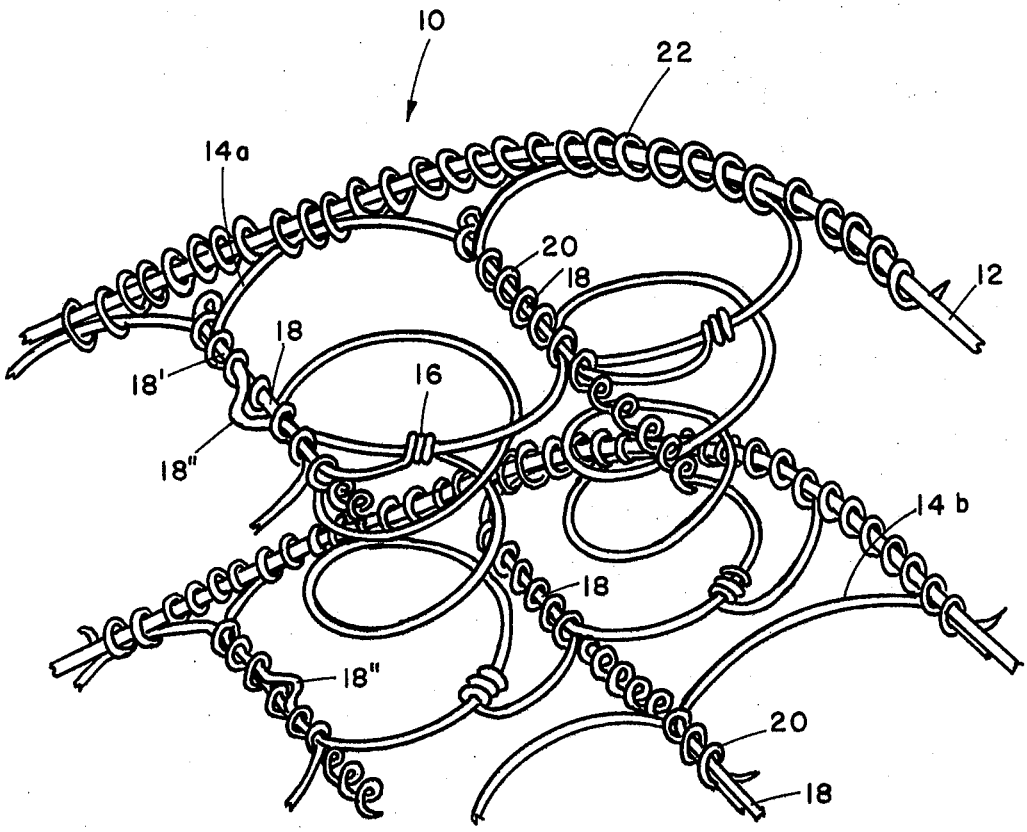
FIG. 3 is a fragmentary perspective view of a portion of the assembly.

Each spring of the assembly (except the corner springs as explained below) has its two ends wound, i.e. "knotted" as the feature is known in the trade. That is, the terminal end portion of the coil wire is wrapped around the adjacent turn of the spring to form a winding 16 on each end of the spring, for comfort and stability. Moreover, the last turn of each end of each coil spring has a pair of opposite parallel basically linear wire portions oriented normal to the row of springs containing that coil spring. Thus, referring to a spring in the row of springs 14*b*, it has a first linear portion 18 on one side of each end, and a second linear portion 18' on the opposite side of each end. Preferably this second linear portion has an offset bight 18" generally centrally thereof for a reason to be set forth. As noted from FIG. 3, the opposite ends of the spring have these linear portions. The only exception to this pair of linear portions on each and every spring is that optionally, if the support rods 12 are arcuate at the corners of the assembly as shown, the adjacent corner coil springs may have a matching curvature instead of one linear portion. A linear spring portion here could protrude undesirably beyond the arcuate peripheral corner of the assembly.

The linear portions of two adjacent springs in each row lie adjacent each other, in abutment with each other. These abutting linear portions are aligned with like abutting portions in the other rows. The adjacent springs in each row are interconnected with each other by a plurality of parallel cross helicals, i.e. helically configurated wire coils 20 on opposite ends of the springs. These helicals extend across the rows normal to the main dimension of the rows, enveloping each set of two linear portions in abutment with each other on adjacent springs, and thereby connecting the two adjacent springs while also interconnecting the several rows of springs. The helicals extend basically the width of the assembly. There is a like plurality of these cross helicals on the opposite ends of the coil springs (see FIG. 3). Enveloping the two peripheral rods 12 is another pair of helicals 22, these also enveloping the adjacent end turns of each of the coil springs adjacent the peripheral supports, to secure the support rods to the remainder of the assembly.

The offset bights 18" improve the interfit of the springs with cross helicals 20 to forestall slippage therebetween.

This novel assembly achieves the comfort of a knotted construction while also achieving stability against torque twist deterioration. Any torque created in the individual springs by axial force thereon, and tending to cause spring twisting, is counteracted by the noted interconnections of the assembly, and particularly by the interrelationship of the linear portions of individual springs and rows of springs with the connecting cross helicals.

It is conceivable that certain details of the assembly may be modified without departing from the concept.

The embodiments of the invention in which an exclusive property or privilege is claimed are defined as follows.

1. A coil spring assembly comprising:

a pair of peripheral supports lying in a pair of parallel planes; a plurality of individual wire coil springs between said planes arranged in parallel rows across said assembly, the springs in alternate rows having right-hand and left-hand helical coils; the ends of each coil spring being knotted on the respective adjacent turns of the spring; the last turn on each end of each coil spring having a pair of opposite parallel linear portions oriented normal to the row containing that coil spring; said linear portions of successive adjacent coil springs in each row being in abutment; a plurality of cross helicals on parallel axes extending across said rows to interconnect the files, each cross helical enveloping the series of abutting linear portions in successive rows to interconnect adjacent coils in each row and to interconnect adjacent rows together.

2. The assembly in claim 1 wherein a linear portion on each end of each spring includes an offset bight to engage the cross helical.

3. The assembly in claim 1 wherein said peripheral supports comprise peripheral rods, and the assembly having helicals which encircle said rods and a portion of the adjacent coils.

* * * * *